United States Patent [19]

Lidik et al.

[11] 4,296,683

[45] Oct. 27, 1981

[54] CAN CRUSHER

[76] Inventors: Albert F. Lidik, 105 Cherry St.; Randall E. Talley, III, 2910 Johnson St., both of Kissimmee, Fla. 32741

[21] Appl. No.: 55,205

[22] Filed: Jul. 6, 1979

[51] Int. Cl.[3] ..... B30B 9/32

[52] U.S. Cl. ..... 100/53; 100/DIG. 2; 100/99; 100/215; 100/256; 100/283; 100/902

[58] Field of Search ..... 100/DIG. 2, 53, 215, 100/218, 256, 280, 283, 291, 292, 99

[56] References Cited

U.S. PATENT DOCUMENTS

| | | | |
|---|---|---|---|
| 2,128,630 | 8/1938 | Wright | 100/DIG. 2 |
| 3,048,096 | 8/1962 | Guedel | 100/DIG. 2 |
| 3,659,520 | 5/1972 | Garrett | 100/DIG. 2 |
| 3,817,169 | 6/1974 | Bischoff | 100/DIG. 2 |
| 3,916,780 | 11/1975 | Heiser | 100/DIG. 2 |
| 3,960,070 | 6/1976 | McClure | 100/DIG. 2 |
| 4,240,341 | 12/1980 | Whipple | 100/DIG. 2 |

*Primary Examiner*—Billy J. Wilhite

*Attorney, Agent, or Firm*—Sughrue, Mion, Zinn, Macpeak and Seas

[57] ABSTRACT

A can crusher having a housing, a hopper removably supported on the housing for holding cans to be crushed, a baffle secured inside the hopper gravitationally supports cans thereon and permits descent of the cans into the bottom of the hopper whereby said cans drop into and rest upon a can cradle attached to a ram, a drive sprocket extending from a motor is connected to a sprocket wheel whereby the sprocket wheel turns upon turning of the drive sprocket, a ram connected to the sprocket wheel pivots on a ram support and reciprocates within guide means on said ram support upon turning of the sprocket wheel, a can engaging plate attached to the ram advances toward a can engaging plate attached to the ram support, a can supported on the can cradle is crushed between the plates as the ram advances with the sprocket wheel, the crushed can drops by gravity through an opening in the bottom of the housing upon the return stroke of the ram.

8 Claims, 9 Drawing Figures

FIG 1
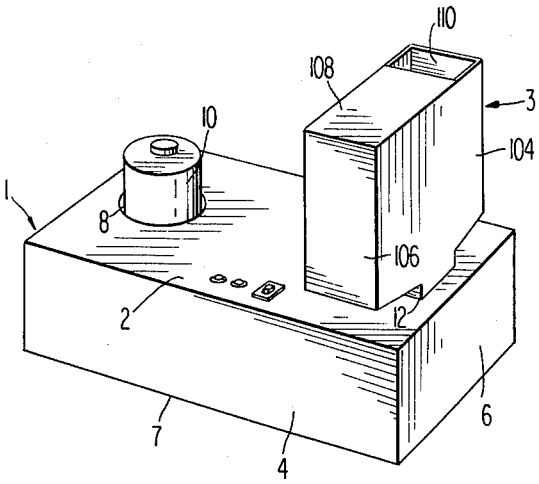
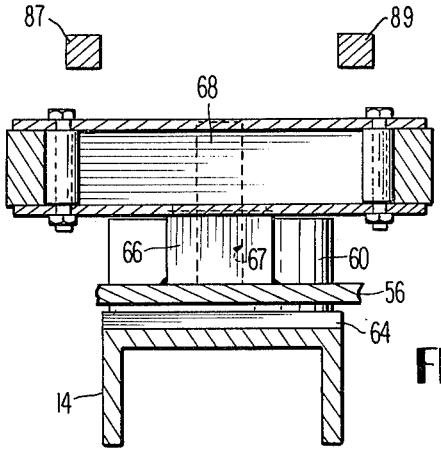
FIG 5
FIG 9
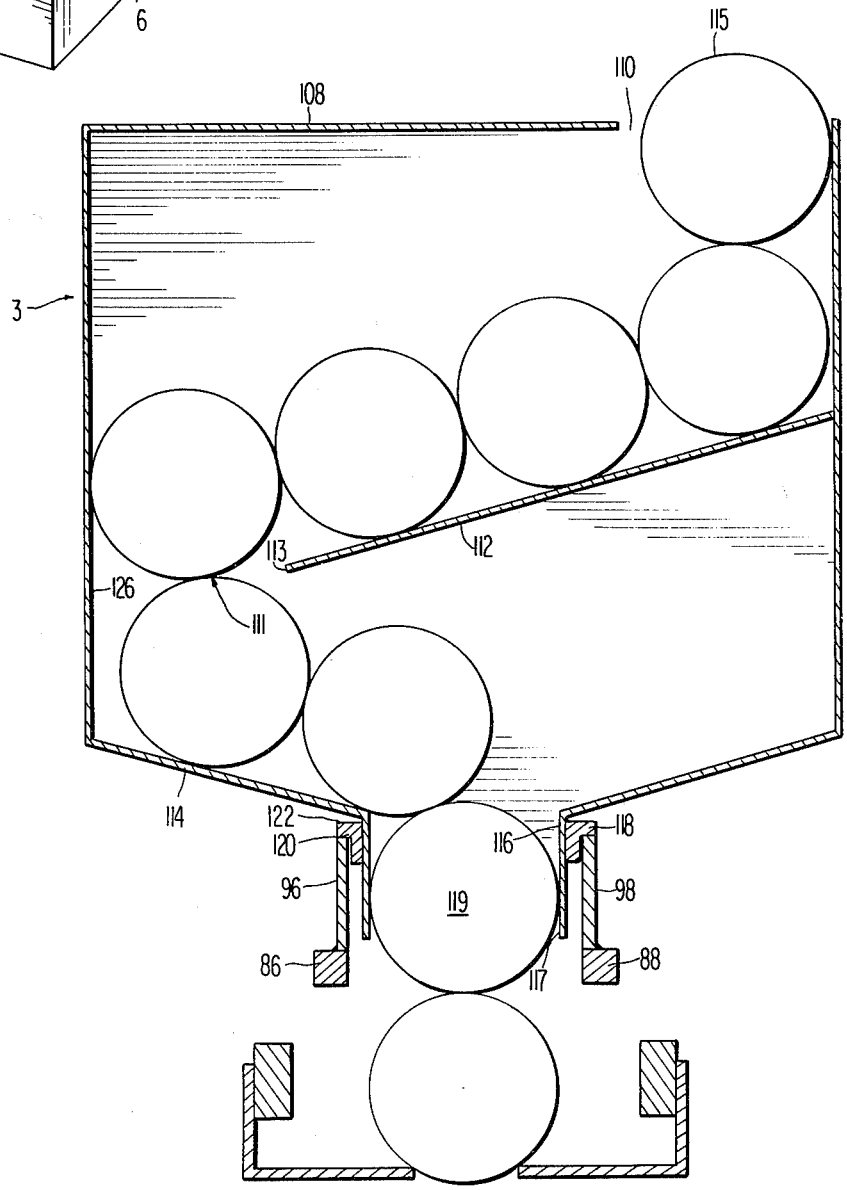

CAN CRUSHER

SUMMARY OF THE INVENTION

One of the principal features of the present invention is to provide a can crusher which will crush cans more efficiently and inexpensively than herebefore developed.

Another feature of the present invention is to provide a can crusher which will operate from a 1/20 or 1/40 horse power motor which is quiet during operation, small and light weight in size and highly efficient, reducing a standard 12 ounce can to ⅛ of its normal size.

Another principal feature of the present invention is to provide a hopper for cans which can be easily removed for cleaning or storing when not in use. A jamming switch means is provided which, upon reversal of the motor which occurs automatically in the event of a jamming condition, is actuated to stop the motor thus holding the crusher in full open position. A warning light is provided which is lighted in response to the actuation of the jamming switch whereby the operator is alerted to a jammed condition.

Another feature of the present invention is to provide a can crusher which is fully automatic and can be supported on a large drum so that as the crusher is operated cans thus crushed drop through an opening in the bottom of the housing and into the drum.

Other principal features of the invention will become apparent as the following description proceeds and as considered with the accompanying drawings wherein:

FIG. 1 is a perspective view of the can crusher.

FIG. 5 is an elevated view taken along the line 5—5 of FIG. 2 and shows the ram connected to the crank pin block.

FIG. 9 is an elevated end view of the hopper supported on the hopper support.

DESCRIPTION OF THE PREFERRED EMBODIMENT

Figure 2:
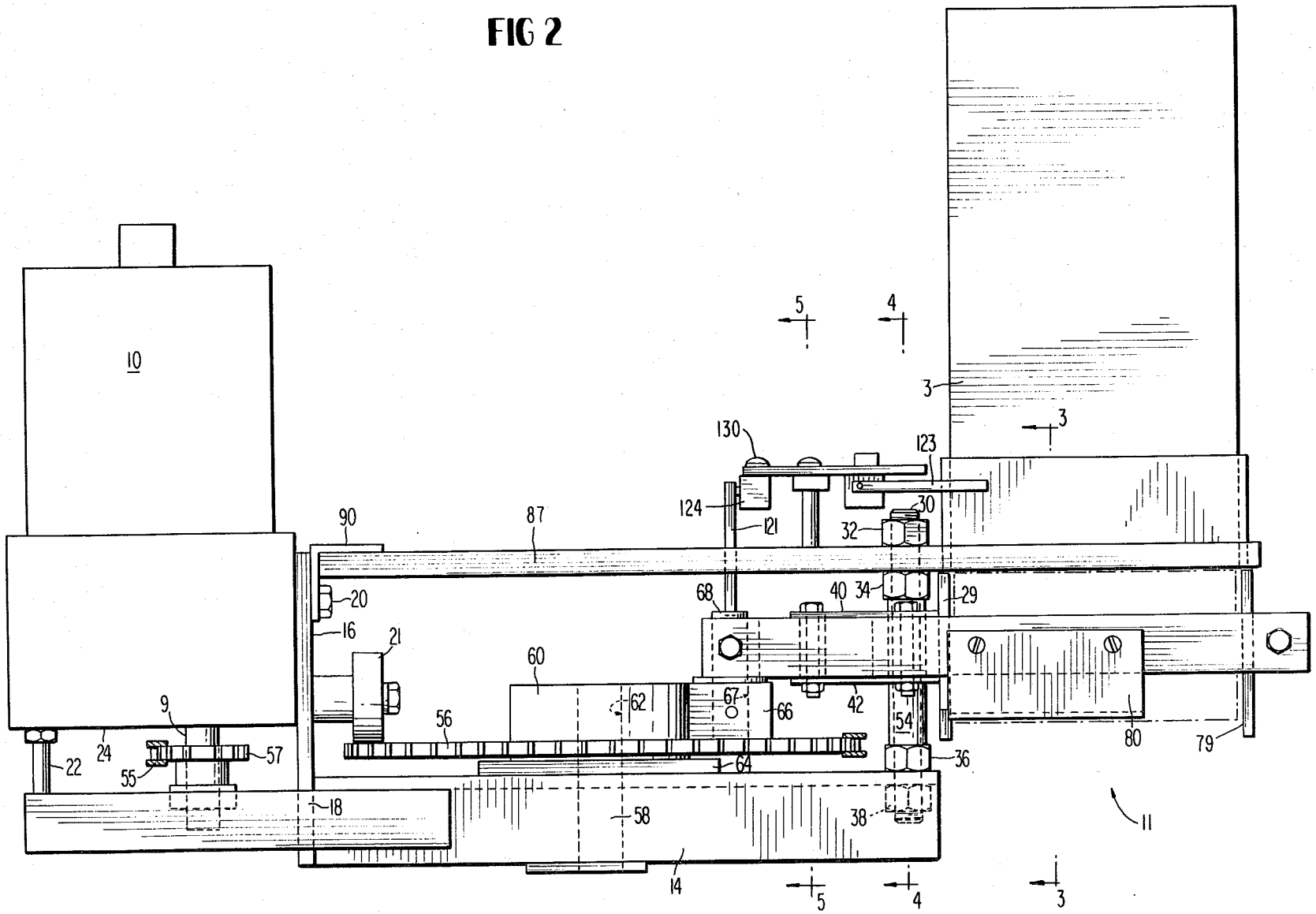
FIG. 2 is a side elevational view of the crusher with the sides removed.

A can crusher is shown in FIG. 1 wherein a housing is provided generally referenced 1 and has a top wall 2, side walls 4 (one shown) end walls 6 (one shown) and bottom wall 7. The top wall 2 has an opening 8 therein at one end therof for receiving a motor 10, a second opening 12 is provided for removably supporting a hopper 3 therein. The bottom wall 7 has an opening 11 therein, as best seen in FIG. 2 for gravitational discharge of crushed cans.

A first frame 14 is secured within the housing 1 by suitable means. The first frame has motor mounting means 16 secured at 18 near to one end of the first frame as by welding or the like. The motor 10 is secured to the motor mounting means 16 by bolts 20 (one shown). Additional support is provided by bolts 22, the ends of which are provided with threads for turning into similarly threaded openings (not shown) in the bottom 24 of the motor 10. The opposite ends of the bolt 22 are secured to the distal end of the frist frame 14 by welding or the like. A sprocket wheel alignment means 21 is rotably supported on the motor mounting means 16 and engages a sprocket wheel 56 for rotation therewith, providing both stability and alignment for the sprocket wheel as it rotates.

Figure 4:
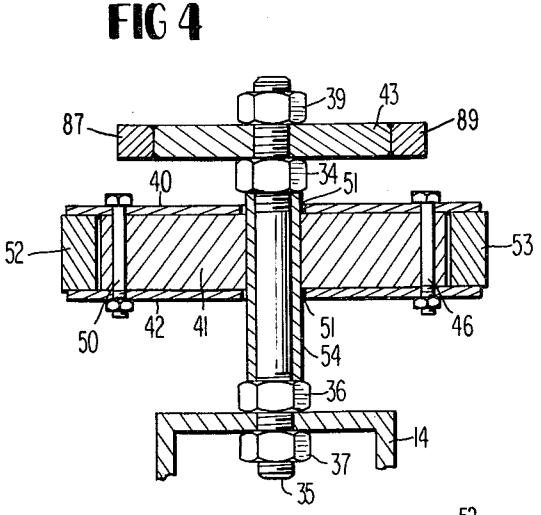
FIG. 4 is an elevated view taken along the line 4—4 of FIG. 2 and shows, in more detail, the ram support.
Figure 3:
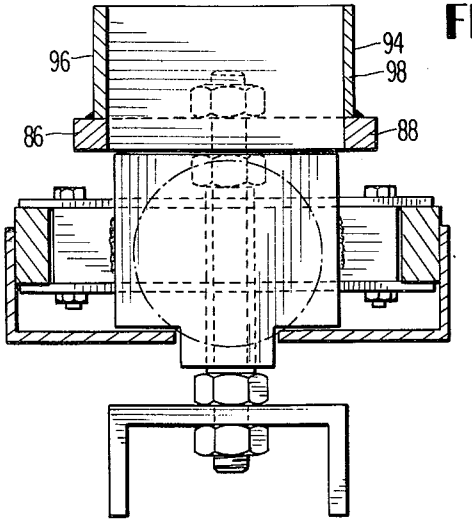
FIG. 3 is an elevated end view taken along the line 3—3 of FIG. 2 and shows the ram support and hopper support.
Figure 6:
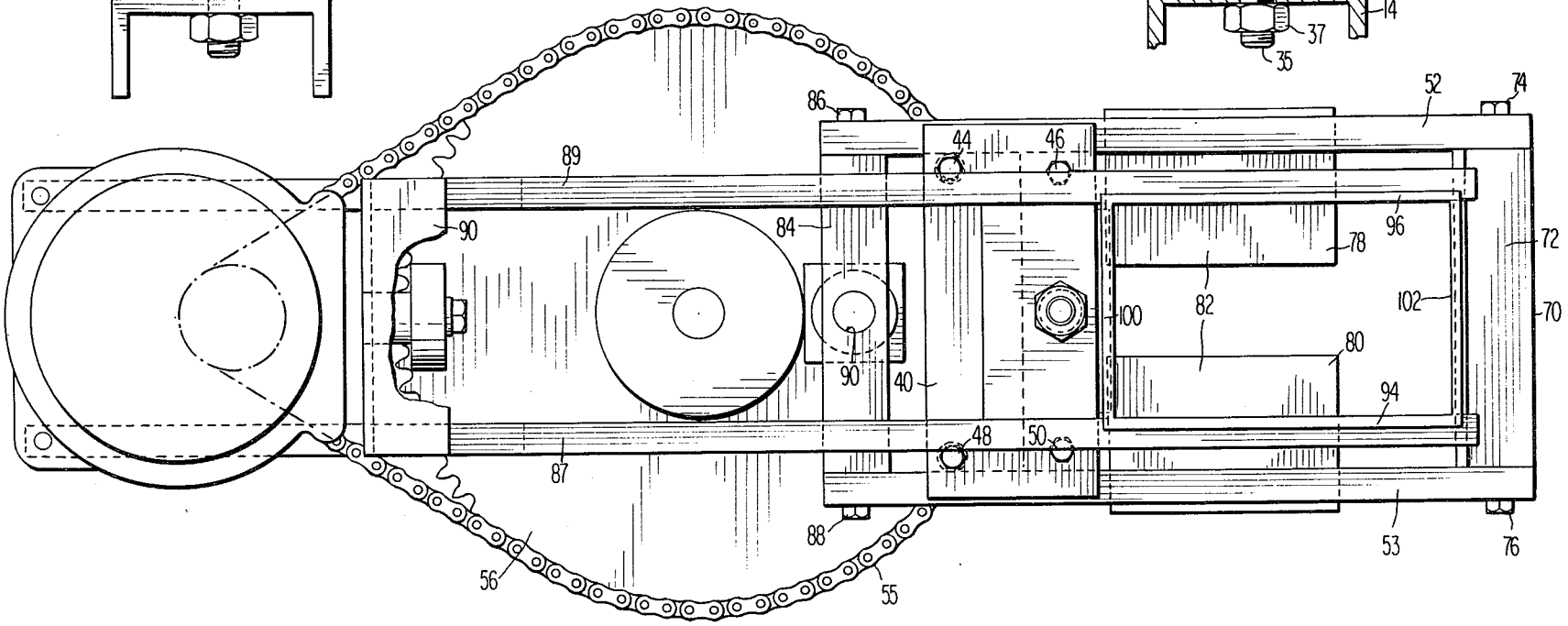
FIG. 6 is a top view of the crusher mechanism showing the ram in fully open position.

Ram guide rails support, FIGS. 4 and 6, comprises a pair of plates 40 and 42 between which is secured a block 41 by bolts 40, 46, 48 and 50. A can engaging plate 29 is rigidly secured to the ram support as by welding to the block 41. The space between the ends of the plates 40 and 42 and the ends of the block 41 define support and guide means for the ram rails 52 and 53 of ram 70. The plates 40 and 42 and block 41 are provided with apertures 51 for rigidly securing a cylindrical tube 54 therein. The ends of the cylindrical tube 54 extends through the aperture 51 and beyond the plates 40 and 42 and rest against nuts 34 and 36. Bolt 35 extends through the cylindrical tube 54 and is secured to the first frame 14 by bolts 36 and 37 and is secured to a support plate 43 of a second frame by bolts 34 and 39. The ram support thus defined is freely pivotable about the bolt 35 between said first frame 14 and the plate 43 of said second frame.

A sprocket wheel 56 having a hub 60 and a bore 62 therethrough, FIG. 2, is rotably supported on the first frame 14 by a pin 58 secured to the first frame 14 and extending into the bore 62. A bearing surface 64 is provided between the first frame 14 and the sprocket wheel 56 whereby the sprocket wheel rotates with minimum of friction. Secured to the hub 60 is a crank pin block 66 having a bore 67 therethrough for receiving an end of crank pin 68.

The motor 10 is provided with a toothed drive sprocket 57 secured to a shaft 58 extending from the bottom 24 of the motor 10. The toothed drive sprocket 57 is attached to the sprocket wheel 56 by means of a chain 55 whereby the sprocket wheel 56 is driven by the toothed drive sprocket 57 during operation of the motor 10. The ratio of the number of teeth of the toothed drive sprocket and the sprocket wheel is such as to obtain a ratio of six to one. This ratio is designed to provide optium operation of the crusher.

A ram 70, FIG. 6, comprises a pair of horizontally spaced apart guide rails 52 and 53 having a bar 72 secured therebetween and to one end thereof by bolts 74 and 76. A can engaging plate 79, FIG. 2, is secured to the bar 72 by welding of the like. A pair of angle members 78 and 80 are secured to the guide rails 52 and 53 defining a can cradle 82. A rod block 84 is secured between the guide rails 52 and 53 at the opposite ends thereof by bolts 86 and 88. An aperture 90 extends through the rod block 84 for receiving the crank pin 68 thereby securing the rod block 84 to the crank pin block 66.

A second frame comprising a pair of horizontally spaced apart rails 87 and 89, FIG. 6 and having motor mounting means 90 secured to the rails at one end thereof, FIG. 2. Bolts 20 and (one shown) secure the rails and the motor mounting means 90 to the motor 10. Hopper support means secured to the opposite ends of the rails by suitable means such as welding or the like, comprises side plates 94 and 96 and end plates 100 and 102, as best seen in FIG. 6, and define a generally rectangular structure on which the hopper rests. A support plate 43 for the ram support is secured between the rails 87 and 89 such as by welding or the like, and is located adjacent to the hopper support means.

The hopper 3, FIG. 1, comprises side walls 104, end walls 106, (one shown), top wall 108 and bottom wall 114. An opening 110 is provided in the top walls for depositing cans 115 into the hopper. A baffle 112, FIG. 9, is secured inside the hopper to one end wall and two side walls thus defining a downwardly slanting surface for gravitationally supporting cans thereon. The space between the other end wall and the unattached portion 113 of the baffle define an opening 111 through which the cans descend into the hopper. The bottom wall 114 of the hopper slopes downwardly and terminates in a depending skirt like section 116. The ends 117 of the skirt like section define an opening 119 to which the cans descend into the ram and resting on the ram cradle 82. Angle members 118 and 120 are secured to the skirt like section 116 by welding or the like near the juncture 122 where the bottom wall 114 joins with the skirt like section 116 and defines support means for the hopper.

A first switch arm 121 is provided which is connected at one end to a switch 124. The opposite end of the switch arm 121 contacts the crank pin 68 whereby the motor 10 is automatically stopped upon the occurrence of a jamming condition. A second switch 123 is provided which connects the motor 10 and the hopper 3 whereby the motor stops immediately upon removable of the hopper during operation of the crusher. The motor is a shaded-pole motor which reverses automatically by sensing tension within the frame, sprockets and chain which occurs during a jamming condition. The switch arm 121 extends into the crusher housing and lies in the area adjacent to the crank pin and is harmlessly by-passed by the crank pin during normal operation. However, upon reversing of the motor, the switch 121 arm is caught by the crank pin 68 which pulls the switch arm backward actuating the switch 124 which stops the motor. When the motor stops, a jamming light 130 is lighted in response to the switch 124 being actuated by the crank pin acting on switch 121, thus, an operator is alerted to a jammed condition.

Figure 7:
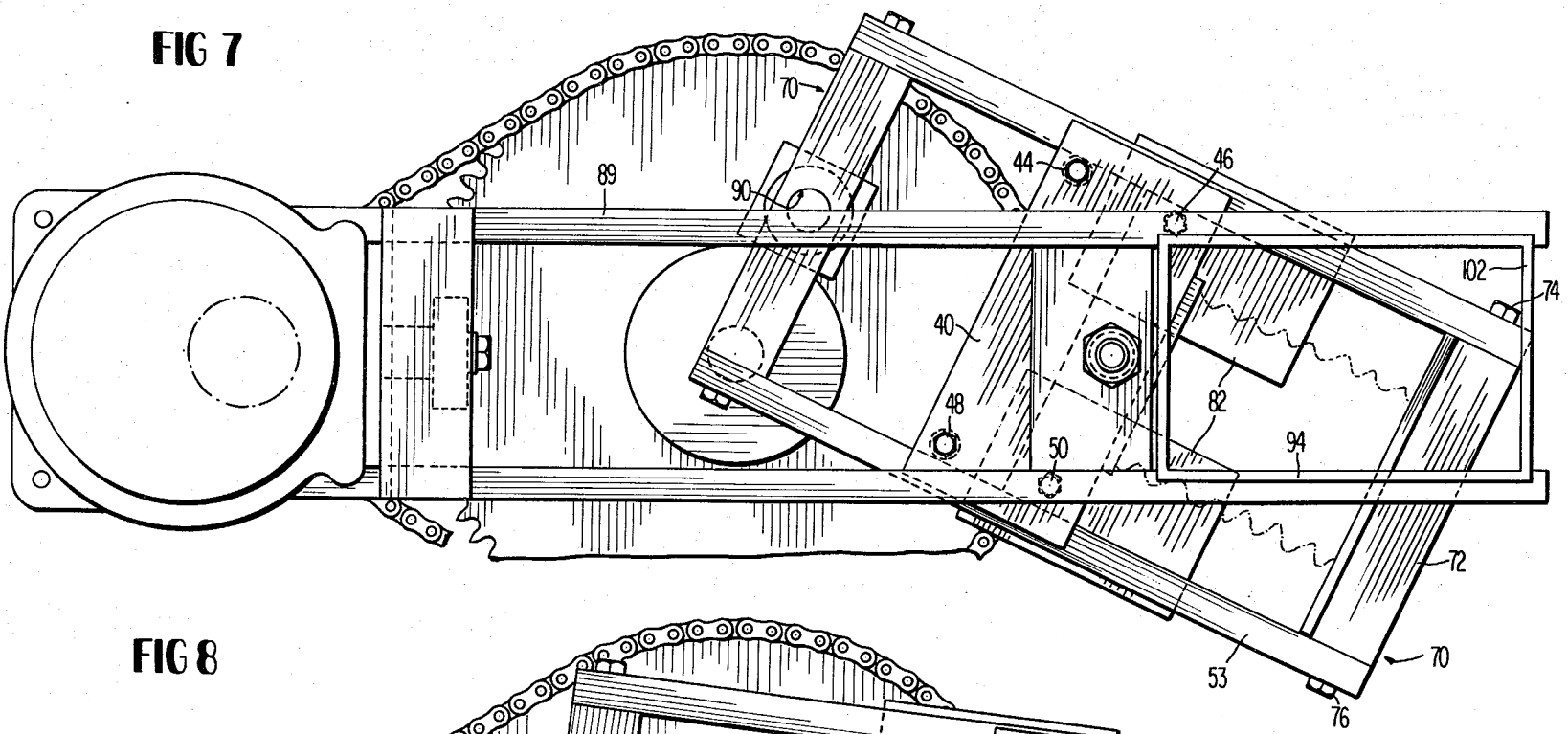
FIG. 7 is a top view showing the ram partially advanced through approximately 80 degrees of turn of the sprocket wheel.
Figure 8:
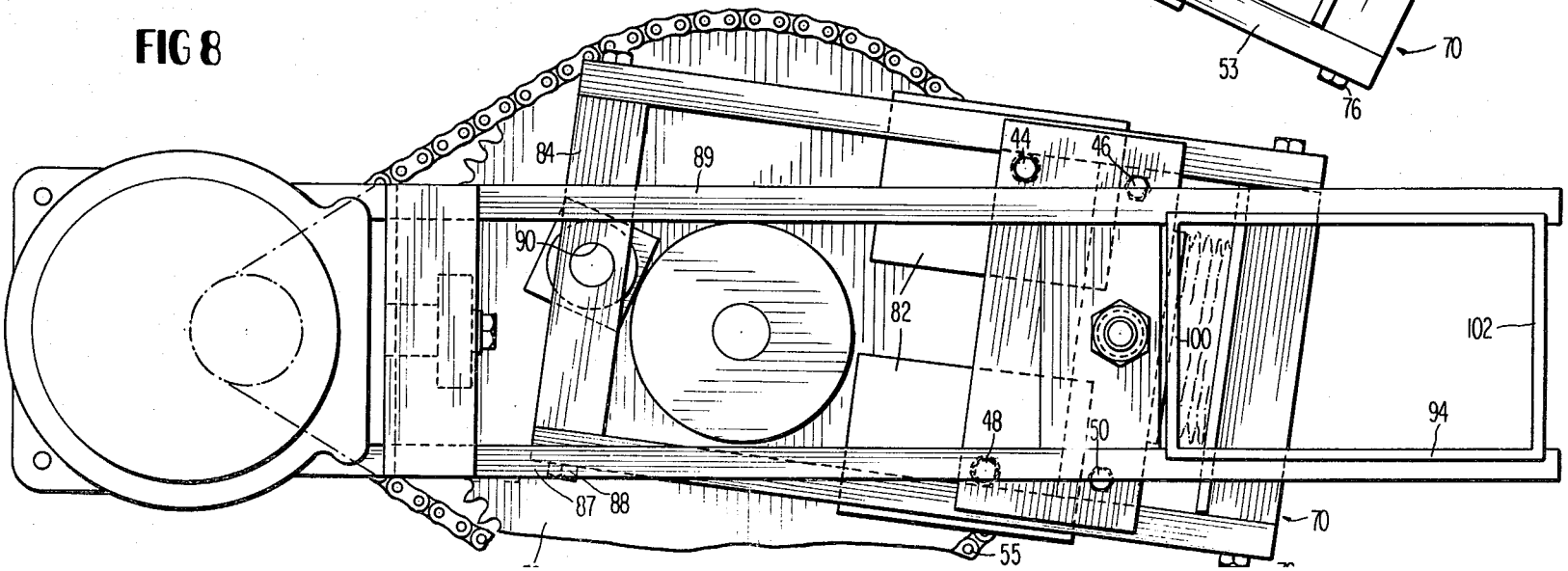
FIG. 8 is a top view showing the ram nearing the completion of the stroke at approximately 170 degrees of turn of the sprocket wheel.

In operation, as cans are deposited into the hopper through opening 110 they descend therethrough by gravity along baffle 112 dropping through opening 111, striking slanting bottom wall 114 and entering opening 119, and dropping into the ram 70, coming to rest on the can cradle 82. As the gear motor is started by suitable means the toothed drive sprocket 57 begins to turn thus turning the sprocket wheel 56 through the connecting chain 55. As the sprocket wheel 56 begins to turn the ram 70, FIGS. 6 and 7, which is connected to the crank pin block 64, begins to move forward pivoting with the ram support, and the guide rails 52 and 53 reciprocate with the guide means. A can resting on the can cradle 82 is engaged by the can engaging plates 29 and 79 and as the ram 70 continues to advance, FIG. 8, the plate 79 advances toward plate 29 crushing a can therebetween. At full stroke of the ram which occurs 180 degrees of rotation of the sprocket wheel 56 the can thus crushed assumes a disc like shape of approximately $\frac{1}{8}$ of its original size. Upon continued rotation of the sprocket wheel 56 the plate 79 begins to retract away from the plate 29 thus releasing the crushed can which falls through opening 11 in the bottom wall 7 of the housing. Continuous rotation of the sprocket wheel 56 alternatively advances and retracts the plates crushing cans therebetween. A large drum may be used to support the can crusher whereby crushed cans may be deposited into such a drum.

Although the invention has been described in great detail with respect to the construction and operation thereof, it is intended that the present disclosure of the preferred embodiment has been made only as an example and that numerous changes in the construction and the arrangement of parts may be resorted to without departing from the spirit and scope of the invention claimed herebelow:

We claim:

1. A can crusher comprising:

a housing;

a hopper removably attached to the housing;

a first frame secured within the housing, including motor mounting means at one end thereof, ram support mounting means at the opposite end, and sprocket wheels supporting means on the frame between the motor mounting means and the ram support mounting means;

a motor secured to the motor mounting means;

a ram support pivotally mounted to the ram support mounting means comprising, a can engaging plate, a pair of plates secured to a block, the space between the ends of said pair of plates and said block define guide means, said pair of plates and said block secured to the can engaging plate, an aperture extending through the pair of plates and the block, and means secured in said aperture for rotatably supporting the ram support to the ram support mounting means;

a sprocket wheel rotatably supported on the sprocket wheel supporting means, said sprocket wheel having a hub integrally secured thereto, a crank pin block secured to said hub and rotatable therewith, said crank pin block having an aperture therein;

means for connecting the sprocket wheel and the motor whereby the sprocket wheel turns upon actuation of the motor;

a ram comprising a pair of horizontally spaced apart guide rails for reciprocating in said guide means, a can engaging plate secured to one end of the guide rails, a can cradle secured between the guide rails for supporting a can between the can engaging plate secured to the guide rails and the can engaging plate of the ram support, means for connecting the opposite ends of the guide rails to the crank pin block of the sprocket wheel hub so that as the sprocket wheel turns, the guide rails pivot with the ram support and reciprocate in the guide means whereby the can engaging plate of the guide rails advances toward the can engaging plate of the ram support crushing a can supported between said can engaging plates;

a second frame having means for securing one end thereof to the motor, and hopper supporting means at the opposite ends of the frame whereby the hopper is removably attached thereto, ram support plate mounted on the frame and means for securing the ram support plate, the ram support and the first frame together;

a switch mounted on the inside of the housing;

a switch arm extending from the switch into the housing a distance sufficient to contact the crank pin during rotation thereof, said switch arm inoperable to activate the switch during counterclockwise revolution of the crank pin and operable to activate the switch to stop the motor during clockwise rotation of the crank pin; and an indicator operable in response to activation of the switch and stopping of the motor to indicate a jammed condition.

2. A can crusher as defined in claim 1, wherein said housing comprises, top and bottom panels, and side and end panels connected together by suitable means, said top panel having an opening therein at one end thereof for the motor, a second opening at the opposite end of said top panel for removably receiving the hopper, and an opening in the bottom panel at one end thereof for discharging crushed cans.

3. A can crusher as defined in claim 1, wherein said hopper comprises a housing having side and end walls and top and bottom walls, said top wall having an opening therein for depositing cans into the hopper, a baffle plate secured within the hopper to the side walls and one end wall thereof and defining a downwardly slanting surface for gravitationally supporting cans thereon, an opening defined by the other end wall and the unattached edge of the baffle for permitting descent of the cans into the bottom of the hopper, said bottom wall sloping downwardly and terminating in a depending skirt like section, and said skirt like section having means for supporting the hopper on the hopper supporting means.

4. A can crusher as defined in claim 1, wherein said motor comprises a 1/40 HP motor having a toothed drive sprocket extending therefrom, said toothed drive sprocket and said sprocket wheel providing a ratio of six to one.

5. A can crusher as defined in claim 1, wherein said means for connecting the opposite ends of the guide rails to the crank pin block comprises a rod block secured between the guide rails and having an aperture extending therethrough a pin extending through the aperture and connecting the rod block to the crank pin block.

6. A can crusher as defined in claim 2, wherein said means for rotatably supporting said ram support means comprises a cylindrical tube.

7. A can crusher as defined in claim 1, wherein said means for connecting the sprocket wheel and the motor comprises a toothed drive sprocket and a chain.

8. A can crusher comprising:

a housing;

a hopper having means for removably attaching the hopper to the housing;

a first frame secured within the housing;

a ram support pivotally mounted to the opposite end of the first frame, said ram support having a can engaging plate;

a sprocket wheel supported on the first frame between the motor and the ram support, said sprocket wheel having a crank pin block secured thereto;

means for connecting the sprocket wheel to the motor whereby said sprocket wheel turns upon actuation of said motor;

a ram supported on the ram support means, said ram having a can engaging plate, means on said ram for supporting a can between the can engaging plates of the ram and the ram support means, means for connecting the ram to the crank pin block of the sprocket wheel whereby the can engaging plate of the ram advances toward the cam engaging plate of the ram support means upon turning of the sprocket wheel thereby crushing a can therebetween;

a second frame having means for securing one end thereof to a motor, hopper supporting means at the opposite end of the frame whereby the hopper is removably attached thereto, and means for securing the ram support to the second frame; and switch means secured to the housing operable to stop the motor upon reversal thereof, and indicator means for indicating a jammed condition.

* * * * *